US007874851B2

(12) United States Patent
Shimizu

(10) Patent No.: US 7,874,851 B2
(45) Date of Patent: Jan. 25, 2011

(54) EARTH CONNECTION UNIT

(75) Inventor: Tomohiko Shimizu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/649,384

(22) Filed: Dec. 30, 2009

(65) Prior Publication Data

US 2010/0178784 A1 Jul. 15, 2010

(30) Foreign Application Priority Data

Jan. 14, 2009 (JP) ..... P. 2009-005753

(51) Int. Cl.
*H01R 4/66* (2006.01)

(52) U.S. Cl. ..... 439/92; 439/620.21

(58) Field of Classification Search ..... 439/92, 439/95, 97, 620.01, 620.21, 620.22, 658; 174/51

See application file for complete search history.

(56) References Cited

U.S. PATENT DOCUMENTS

| | | | | |
|---|---|---|---|---|
| 7,252,551 | B2 * | 8/2007 | Ueno et al. | 439/620.21 |
| 7,297,029 | B2 * | 11/2007 | Ueno et al. | 439/620.21 |
| 7,470,151 | B2 * | 12/2008 | Yamaguchi et al. | 439/658 |
| 7,648,397 | B2 * | 1/2010 | Shimizu | 439/620.21 |
| 7,683,254 | B2 * | 3/2010 | Shimizu | 174/51 |
| 7,744,425 | B2 * | 6/2010 | Shimizu | 439/658 |
| 7,759,584 | B2 * | 7/2010 | Shimizu | 174/541 |
| 2006/0073738 | A1 * | 4/2006 | Nagaoka et al. | 439/721 |
| 2007/0270019 | A1 | 11/2007 | Yamaguchi et al. | |
| 2008/0304211 | A1 * | 12/2008 | Shimizu | 361/600 |
| 2009/0009981 | A1 * | 1/2009 | Shimizu | 361/807 |
| 2009/0017653 | A1 * | 1/2009 | Shimizu | 439/95 |
| 2009/0042444 | A1 * | 2/2009 | Shimizu | 439/620.21 |
| 2009/0042456 | A1 | 2/2009 | Yamaguchi et al. | |
| 2009/0139741 | A1 * | 6/2009 | Shimizu | 174/51 |

FOREIGN PATENT DOCUMENTS

| | | |
|---|---|---|
| JP | 2006-109587 A | 4/2006 |
| JP | 2007-311630 A | 11/2007 |

* cited by examiner

*Primary Examiner*—T C Patel
*Assistant Examiner*—Vladimir Imas
(74) *Attorney, Agent, or Firm*—Sughrue Mion, PLLC

(57) ABSTRACT

An earth connection unit, in which the elastic engagement piece portion of the earth plate for locking the earth plate to the unit case is engaged with the engagement projection formed on the outer side surface of the unit case, and wherein the elastic engagement piece portion formed on the earth plate is covered with the engagement piece cover integrally interconnecting the plurality of opening covers, and is not exposed to the exterior.

4 Claims, 17 Drawing Sheets

EARTH CONNECTION UNIT

BACKGROUND OF THE INVENTION

1. Field of the Invention

This invention relates to an earth connection unit used for groundedly connecting a wire (mounted, for example, on a vehicle) to a vehicle body or the like in order to remove high-frequency noise carried on the wire.

2. Background of the Invention

For example, various sensors, etc., mounted in an automobile or the like are often supplied through an electric wire with noise transmitted from a noise source (such as a horn and a wiper motor) having a high frequency component, external noise from a neon sign and others, induction noise and other noises. There has been encountered a problem that such inputted noise causes a malfunction.

Therefore, in order to remove the above noise, it has been proposed to groundedly connect the wire (which carries the noise) to a vehicle body via an earth connection unit.

FIGS. 16 and 17 show the above conventional earth connection unit.

This conventional earth connection unit 1 comprises two electrical elements 2 and 3 each having a pair of lead terminals 2*b* and 2*c*, 3*b* and 3*c* extending from an element body 2*a*, 3*a* thereof, wire terminals 7 each including a wire connection portion 7*a* for electrical connection to a conductor 5*a* of a corresponding wire 5 and an external connection terminal portion 7*c* for electrically connecting the wire connection portion 7*a* to the exterior, relay terminals 9 made of a metal sheet and including a terminal connection portions 9*a* for electrical connection to the external connection terminal portion 7*c* of the corresponding wire terminal 7 and a lead connection portion 9*b* for being soldered to one lead terminal 2*b*, 3*b* of the corresponding electrical element 2, 3, an earth plate 11 made of a metal plate (or sheet) and including an earth connection portion 11*a* formed on and extending from one edge of a mounting plate portion 11*b* thereof so as to be fastened to an earth connection-purpose structural member (such as a vehicle body) and two element connection portions 11*c* formed on and extending from other edges of the mounting plate portion 11*b* so as to be electrically connected respectively to the other lead terminals 2*c* and 3*c* of the two electrical elements 2 and 3, a synthetic resin-made unit case 13 on which the above component parts are mounted, two opening covers 15 for being attached to the unit case 13, and two terminal covers 17.

The unit case 13 has a bottom wall 21, and a plate portion placing portion 21*a* for the placing of the mounting plate portion 11*b* of the earth plate 11 thereon, as well as two connection portion placing portions 21*b* for the placing of the respective element connection portions 11*c* thereon, is formed on an outer surface of the bottom wall 21. An element receiving portion for receiving the electrical elements 2 and 3 and two parts receiving portions each for receiving the corresponding relay terminal 9 and wire terminal 7 are provided at the inner side of the bottom wall 21.

A plurality of working openings 21*c* are formed through the bottom wall 21 of the unit case 13, and each relay terminal 9 and the one lead terminal 2*b*, 3*b* of the corresponding electrical element 2, 3 which are received in the corresponding parts receiving portion in contacted relation to each other are soldered together through the corresponding working opening 21*c*.

When each opening cover 15 is inserted from the side surface side of the unit case 13 along the bottom wall 21 to be disposed over the working opening 21*c*, lock projections 15*a* formed respectively on opposite side edges of the opening cover 15 are engaged with respective engagement portions 21*d* formed on the bottom wall 21, so that the opening cover 15 is fixed to the bottom wall 21 to close the working opening 21*c*.

Each wire terminal 7 mounted on the wire 5 is received and held in the terminal cover 17, and in this condition the terminal cover 17 is fittingly attached to the unit case 13 to cover an outer surface of the wire terminal 7 received in the unit case 13.

In the assembled condition of the above earth connection unit 1 as shown in FIG. 16, the conductor 5*a* of each wire 5 is electrically connected to the earth plate 11 via the electrical element 2, 3, and is grounded when the earth connection portion 11*a* of the earth plate 11 is fastened to the vehicle body. When capacitors of a predetermined capacity are used as the electrical elements 2 and 3, the above earth connection unit 1 is used as a noise filter for removing high-frequency noise carried on the wire 5 (see, for example, Patent Literature 1 and Patent Literature 2).

Incidentally, in the case of the above earth connection unit 1, the earth plate 11 is fixed to the plate portion placing portion 21*a* by engaging a plate clamp 24 (formed on and projecting from the plate portion placing portion 21*a*) in an engagement hole 11*d* formed through the mounting plate portion 11*b*. Further, an elastic engagement piece portion 11*e* formed on and extending from the side edge of the mounting plate portion 11*b* is engaged with an engagement projection 25 formed on and projecting from a side wall of the unit case 13, thereby locking the earth plate 11 to the unit case 13.

Patent Literature 1: JP-A-2006-109587

Patent Literature 2: JP-A-2007-311630

However, in the above earth connection unit 1, the elastic engagement piece portion 11*e* for locking the earth plate 11 to the unit case 13 is exposed at the outer side surface of the unit case 13, and therefore it has been feared that the elastic engagement piece portion 11*e* might be elastically deformed upon contact from the exterior, so that this locked condition might be canceled.

In addition, in the case where the wire 5 received in the earth connection unit 1 is arranged to pass near to the earth plate 11, it has been feared that the wire 5 might be damaged upon contact with an end edge 27 of the exposed elastic engagement piece portion 11*e*.

Furthermore, in the case of the above earth connection unit 1, the two separate opening covers 15 are provided for respectively covering the working openings 21*c*, and therefore a corresponding number of cover inserting/attaching operations to the number of the electrical elements (2 and 3) to be received in the earth connection unit 1 need to be carried out, and this invited a problem that the number of the component parts as well as the number of assembling steps increased.

SUMMARY OF THE INVENTION

It is an object of this invention to solve the above problems, and more specifically to provide an earth connection unit in which a locked condition of an earth plate relative to a unit case will not be accidentally canceled upon contact from the exterior, and the fixed condition of the earth plate can be maintained in a stable manner, and also wires received in the earth connection unit are prevented from being damaged by contact with an end edge of the earth plate, and further the number of component parts as well as the number of assembling steps can be reduced.

The above object of the invention is achieved by the constructions of the following Paragraph (1) to (3).

Paragraph (1) of this invention provides with an earth connection unit, comprising a plurality of electrical elements, each having an element body and a pair of lead terminals extending from the element body, wire terminals, each including a wire connection portion to be electrically connected with a respective one of a plurality of wires and an external connection terminal portion for electrically connecting the wire connection portion to an exterior, relay terminals, each made of a metal sheet and including a terminal connection portion to be electrically connected with the external connection terminal of the corresponding wire terminal and a lead connection portion to be soldered to one of the pair of lead terminals of the corresponding electrical element, an earth plate, made of a metal plate and including a mounting plate portion, an earth connection portion extending from one edge of the mounting plate portion so as to be fastened to an earth connection-purpose structural member, and a plurality of element connection portions extending from other edges of the mounting plate portion so as to be electrically connected respectively to the other lead terminals of the plurality of electrical elements, a synthetic resin-made unit case, including a bottom wall, a plate portion placing portion on which the mounting plate portion of the earth plate is placed, connection portion placing portions on which the respective element connection portions is placed, the plate placing portion and connection portion placing portions being formed on an outer surface of the bottom wall, the unit case including parts receiving portions provided at the inner side of the bottom wall so as to receive the electrical elements, the relay terminals and the wire terminals, and a plurality of openings being formed through the bottom wall such that each relay terminal and the one lead terminal of the corresponding electrical element which are received in the corresponding parts receiving portion in contacted relation to each other can be soldered together through the corresponding working opening; and a plurality of opening covers so configured that when the opening covers are inserted from the side surface side of the unit case along the bottom wall to be disposed respectively over the openings, lock projections formed respectively on the opening covers are engaged respectively with engagement portions formed on the bottom wall, so that the opening covers are fixed to the bottom wall to close the respective openings; wherein when an elastic engagement piece portion formed on and extending from a side edge of the mounting plate portion of the earth plate is engaged with an engagement projection formed on an outer side surface of the unit case, the earth plate is locked to the unit case; and wherein an engagement piece cover is provided for covering an outer surface of the elastic engagement piece portion of the earth plate, and the plurality of opening covers are formed integrally with the engagement piece cover.

Paragraph (2) of this invention provides with the earth connection unit, wherein an elastic support portion is formed on each of the opening covers, and when the lock projection of each opening cover is to be engaged with the corresponding engagement portion of the bottom wall, the elastic support portion is elastically deformed to displace the lock projection in a direction to facilitate the engagement.

Paragraph (3) of this invention provides with the earth connection unit, wherein the engagement portion includes a provisionally-retaining portion formed on the bottom wall so as to be engaged with the lock projection during the insertion of the opening cover onto the bottom wall to thereby prevent the withdrawal of the opening cover, and a completely-retaining portion formed on the bottom wall so as to be engaged with the lock projection upon complete insertion of the opening cover to thereby prevent the withdrawal of the opening cover, and the provisionally-retaining portion and the completely-retaining portion project in a direction of a width of the opening cover; and the opening cover has a rib disposed at a level below an upper surface of the lock projection and extending in the inserting direction from the lock projection toward a proximal end of the opening cover, and the rib can be located under the engagement portion for engagement with the lock projection.

In the construction of the above Paragraph (1), the elastic engagement piece portion of the earth plate for locking the earth plate to the unit case is engaged with the engagement projection formed on the outer side surface of the unit case. In this condition, the engagement piece cover integrally interconnecting the plurality of opening covers is disposed in generally superposed relation to the outer surface of the elastic engagement piece portion, and therefore the elastic engagement piece portion is covered with the engagement piece cover.

Namely, the elastic engagement piece portion (serving as lock means) formed on the earth plate is covered with the engagement piece cover integrally interconnecting the plurality of opening covers, and is not exposed to the exterior.

Therefore, the locked condition of the earth plate relative to the unit case will not be accidentally canceled by contact from the exterior or other factors, and the fixed condition of the earth plate can be maintained in a stable manner.

In addition, since the elastic engagement piece portion of the earth plate is covered with the engagement piece cover integrally interconnecting the plurality of opening covers, the wires received in the earth connection unit are prevented from contact with an end edge of the elastic engagement piece portion, and therefore are prevented from being damaged by this contact.

Furthermore, the plurality of opening covers are integrally interconnected by the engagement piece cover, and therefore the plurality of opening covers can be attached to the unit case at one time, and the number of the component parts as well as the number of the assembling steps can be reduced.

In the construction of the above Paragraph (2), when the lock projection of each opening cover is to be engaged with the engagement portion of the bottom wall of the unit case, the elastic support portion is elastically deformed to displace the lock projection in the direction to facilitate this engagement. Therefore, as compared with the case where the lock projection is not displaced, an excessive load will not act on the lock projection, thereby avoiding damage of the lock projection.

Furthermore, an operating force required for attaching the opening covers to the unit case can be reduced, and therefore the efficiency of the operation can also be enhanced.

In the construction of the above Paragraph (3), each opening cover has the rib disposed at the proximal end of the lock projection, and when the lock projection is engaged with the provisionally-retaining portion or the completely-retaining portion formed on the bottom wall of the unit case, this rib is located under each of these retaining portions. Thanks to the engagement of the rib with each retaining portion, the opening cover engaged with the unit case is prevented from being lifted, and therefore can be more positively retained on the unit case, and at the same time the opening covers disposed, for example, in their provisionally-retained condition are prevented from being brought out of engagement with the unit case and hence are prevented from dropping from the unit case.

In the earth connection unit of the present invention, the elastic engagement piece portion of the earth plate for locking the earth plate to the unit case is engaged with the engagement projection formed on the outer side surface of the unit case. In this condition, the engagement piece cover integrally interconnecting the plurality of opening covers is disposed in generally superposed relation to the outer surface of the elastic engagement piece portion, and therefore the elastic engagement piece portion is covered with the engagement piece cover.

Namely, the elastic engagement piece portion (serving as the lock means) formed on the earth plate is covered with the engagement piece cover integrally interconnecting the plurality of opening covers, and is not exposed to the exterior.

Therefore, the locked condition of the earth plate relative to the unit case will not be accidentally canceled by contact from the exterior or other factors, and the fixed condition of the earth plate can be maintained in a stable manner.

In addition, since the elastic engagement piece portion of the earth plate is covered with the engagement piece cover integrally interconnecting the plurality of opening covers, the wires received in the earth connection unit are prevented from contact with the end edge of the elastic engagement piece portion, and therefore are prevented from being damaged by this contact.

Furthermore, the plurality of opening covers are integrally interconnected by the engagement piece cover, and therefore the plurality of opening covers can be attached to the unit case at one time, and the number of the component parts as well as the number of the assembling steps can be reduced.

DESCRIPTION OF THE PREFERRED EMBODIMENTS

A preferred embodiment of an earth connection unit of the present invention will now be described in detail with reference to the drawings.

Figure 1:
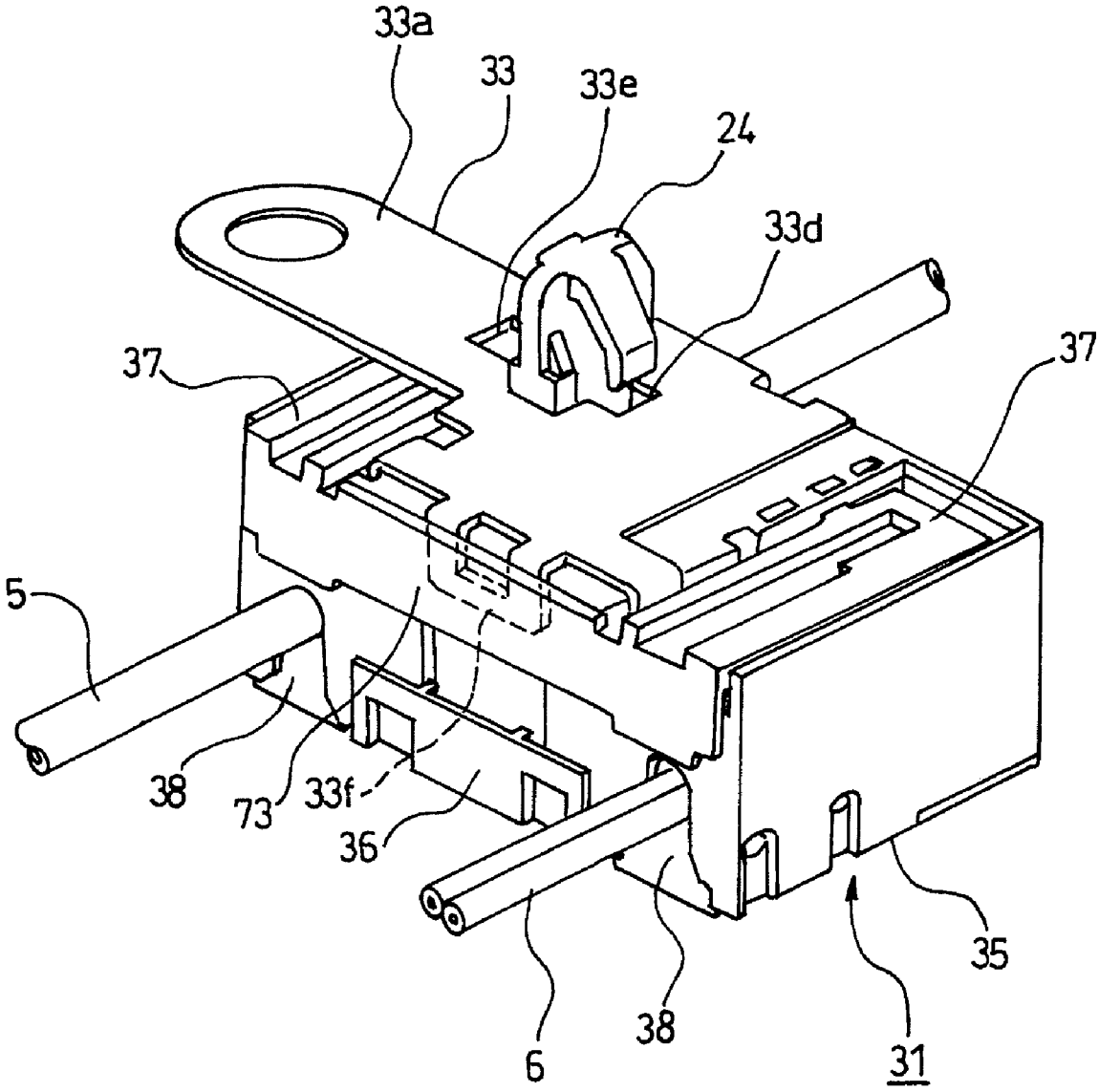
FIG. 1 is a perspective view of one preferred embodiment of an earth connection unit of the present invention.
Figure 2:
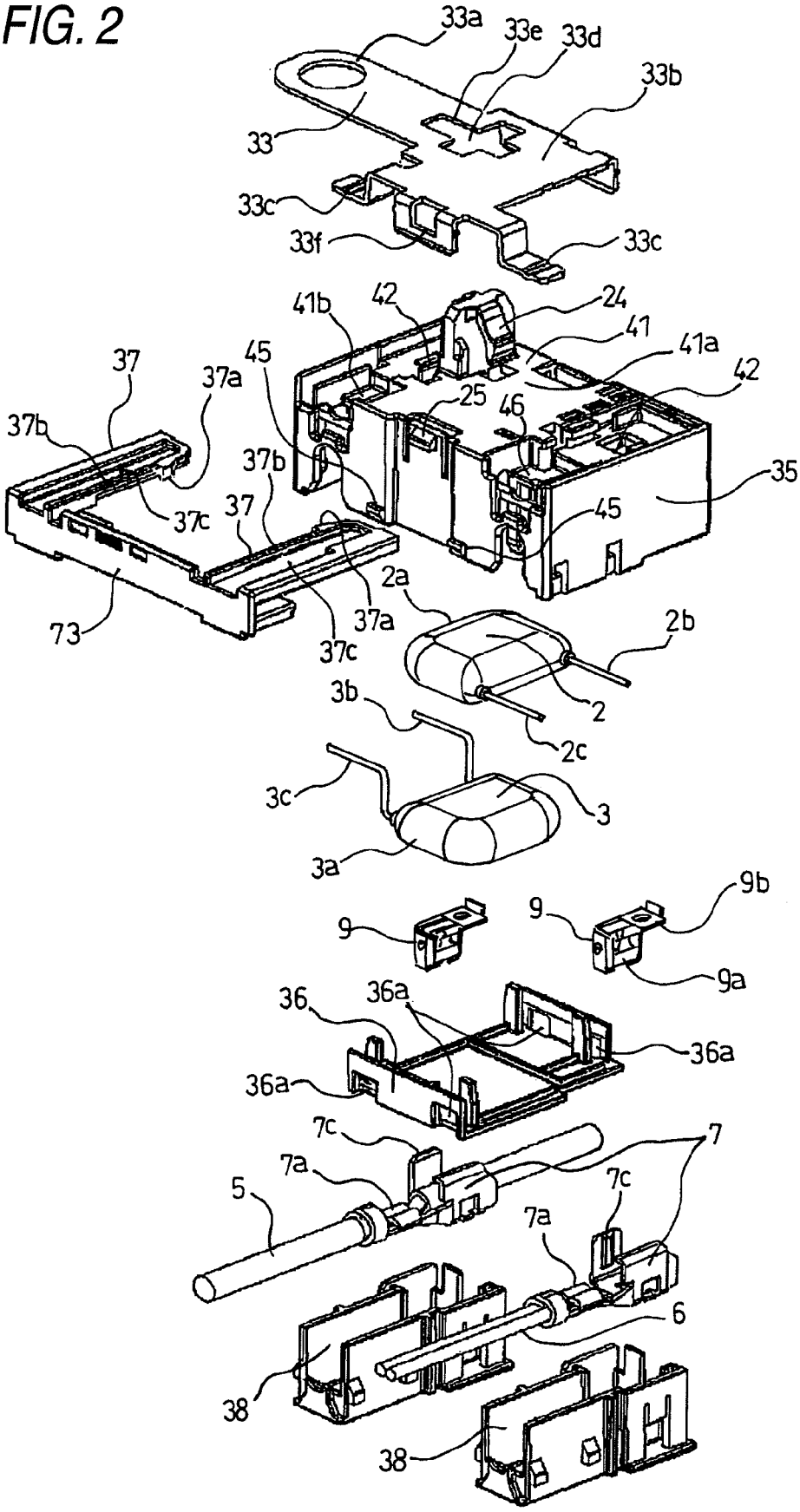
FIG. 2 is an exploded perspective view of the earth connection unit of FIG. 1.
Figure 3:
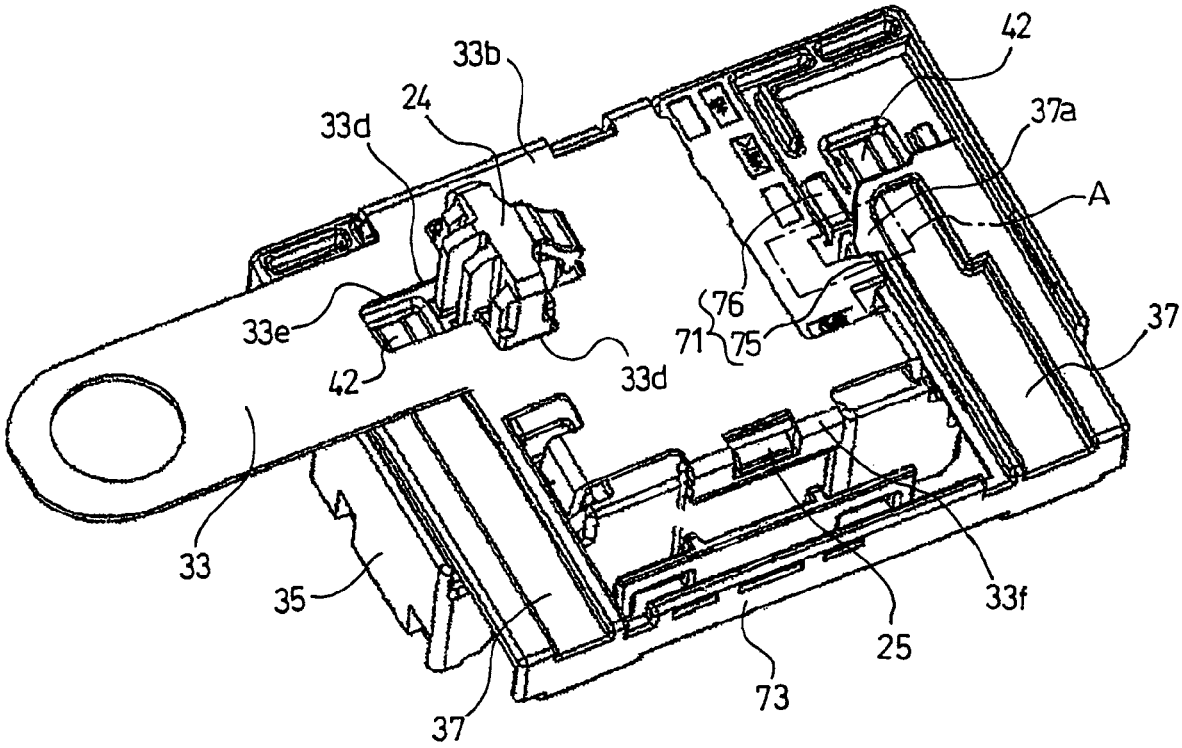
FIG. 3 is a perspective view of the earth connection unit of FIG. 2 as seen from the earth plate side, showing a half-assembled condition in which after an earth plate is attached to a unit case, opening covers are provisionally retained on the unit case.
Figure 4:
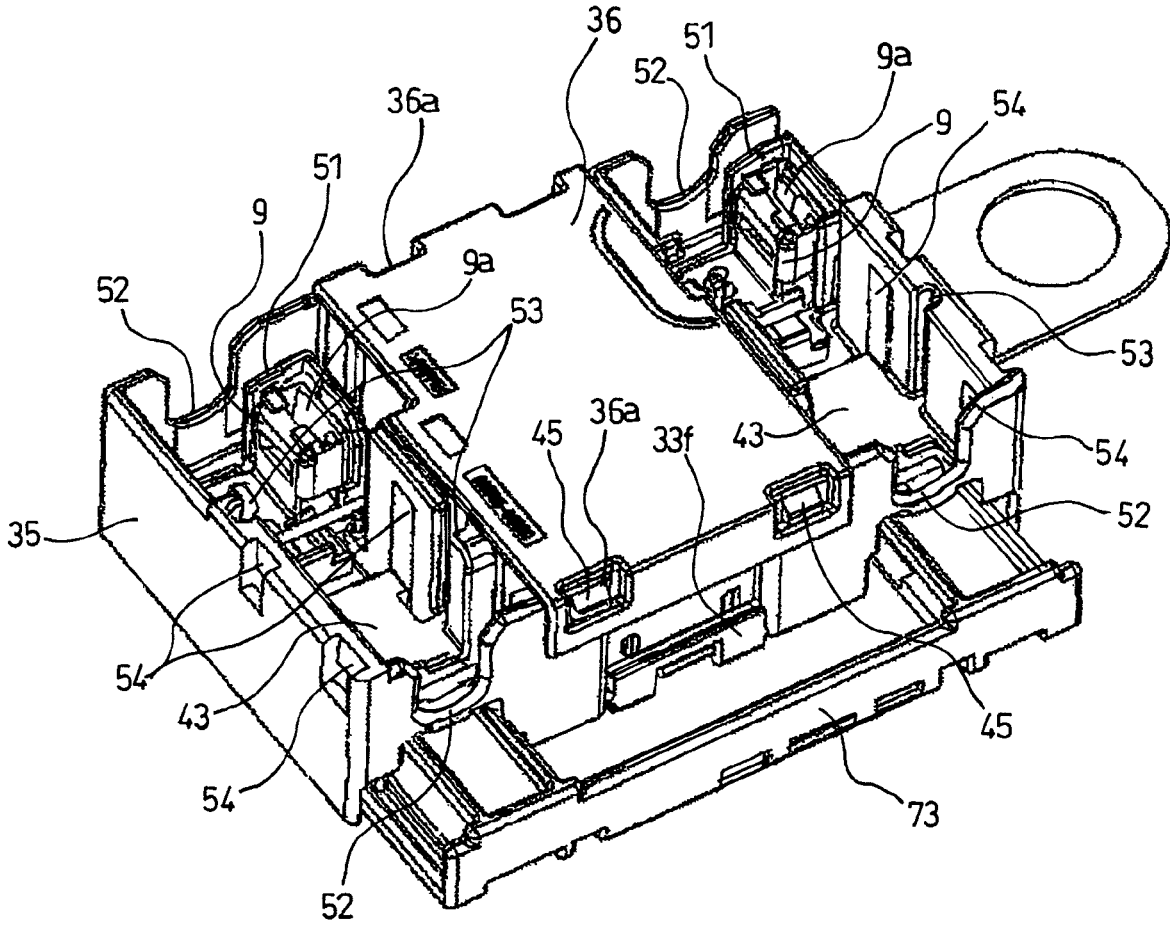
FIG. 4 is a perspective view of the earth connection unit of FIG. 3 in its half-assembled condition, showing the interior of the unit case as seen from that side facing away from the earth plate side.

FIG. 1 is a perspective view of one preferred embodiment of the earth connection unit of the invention, FIG. 2 is an exploded perspective view of the earth connection unit of FIG. 1, and FIG. 3 is a perspective view of the earth connection unit of FIG. 2 as seen from the earth plate side, showing a half-assembled condition in which after an earth plate is attached to a unit case, opening covers are provisionally retained on the unit case. FIG. 4 is a perspective view of the earth connection unit of FIG. 3 in its half-assembled condition, showing the interior of the unit case as seen from that side facing away from the earth plate side.

The earth connection unit 31 of this embodiment comprises two electrical elements 2 and 3 each having a pair of lead terminals 2*b* and 2*c*, 3*b* and 3*c* extending from an element body 2*a*, 3*a* thereof, wire terminals 7 each including a wire connection portion 7*a* for electrical connection to a conductor of the corresponding wire(s) 5, 6 and an external connection terminal portion 7*c* for electrically connecting the wire connection portion 7*a* to the exterior, relay terminals 9 each made of a metal sheet and including a terminal connection portion 9*a* for fitting in the external connection terminal portion 7*c* of the corresponding wire terminal 7 to be electrically connected thereto and a lead connection portion 9*b* for being soldered to one lead terminal 2*b*, 3*b* of the corresponding electrical element 2, 3, the earth plate 33 made of a metal plate (or sheet) and including an earth connection portion 33*a* formed on and extending from one edge of a mounting plate portion 33*b* thereof so as to be fastened to an earth connection-purpose structural member (such as a vehicle body) and two element connection portions 33*c* formed on and extending from other edges of the mounting plate portion 33*b* so as to be electrically connected respectively to the other lead terminals 2*c* and 3*c* of the two electrical elements 2 and 3, the synthetic resin-made unit case 35 on which the above component parts are mounted, an element receiving portion cover 36 for covering an upper side of an element receiving portion receiving the electrical elements 2 and 3 therein, two opening covers 37 for being attached to the unit case 35, and two terminal covers 38.

The earth connection unit 31 of this embodiment is used as a noise filter, and each of the electrical elements 2 and 3 is a capacitor of a predetermined capacity.

The unit case 35 has a box-like structure with a closed bottom, and as shown in FIG. 2, a plate portion placing portion 41*a* for the placing of the mounting plate portion 33*b* of the earth plate 33 thereon, as well as two connection portion placing portions 41*b* for the placing of the respective element connection portions 33*c* thereon, is formed on an outer surface of a bottom wall 41 of the unit case 35. A plate clamp 24 is formed integrally on the plate portion placing portion 41*a*, and this plate clamp 24 is engaged in a mounting-purpose engagement hole 33*d*, formed through the mounting plate portion 33*b*, to hold the mounting plate portion 33*b*.

This plate clamp 24 serves also as a connecting member for connecting the unit case 35 to a clamp hole in the vehicle body.

As shown in FIG. 3, the plate clamp 24 of the unit case 35 is engaged in the mounting-purpose engagement hole 33*d* formed through the mounting plate portion 33*b*, and further an elastic engagement piece portion 33*f* formed on and extending from a side edge of the mounting plate portion 33*b* is engaged with an engagement projection 25 formed on and projecting from an outer side surface of the unit case 35, and by doing so, the fixed condition of the earth plate 33 relative to the unit case 35 is locked.

As shown in FIG. 3, two working openings 42 are formed through the bottom wall 41, and the one lead terminals 2*b* and 3*b* received in the unit case 35 are soldered respectively to the lead connection portions 9*b* of the relay terminals 9 (received in the unit case 35 in contacted relation respectively to the one lead terminals 2*b* and 3*b*) through the respective working openings 42. The two working openings 42 are provided respectively at regions corresponding respectively to parts receiving portions 43 (described later).

The working openings 42 are used also as conduction examination holes.

As shown in FIG. 3, a communication hole 33*e* is formed through the earth plate 33 in continuous relation to the mounting-purpose engagement hole 33*d* so that the mounting plate portion 33*b* will not close the working opening 42, and therefore the working opening 42 is exposed through this communication hole 33*e*.

The element receiving portion for receiving the two electrical elements 2 and 3 superposed together is provided at the inner side of the bottom wall 41 of the unit case 35 at a central portion thereof. After the electrical elements 2 and 3 are received in the element receiving portion, the element receiving portion cover 36 is attached to the unit case 35 to cover this element receiving portion as shown in FIG. 4.

Engagement holes 36*a* are formed through bent portions of the element receiving portion cover 36 disposed respectively at opposite side edges thereof, and these engagement holes 36*a* are engaged respectively with retaining projections 45 formed on an outer side wall of the element receiving portion, thereby fixing the element receiving portion cover 36 to the unit case 35.

As shown in FIG. 4, the parts receiving portions 43 each for receiving the corresponding relay terminal 9 and wire terminal 7 are provided at the inner side of the bottom wall 41 of the unit case 35, and are disposed respectively at the opposite sides of the element receiving portion.

Figure 5:
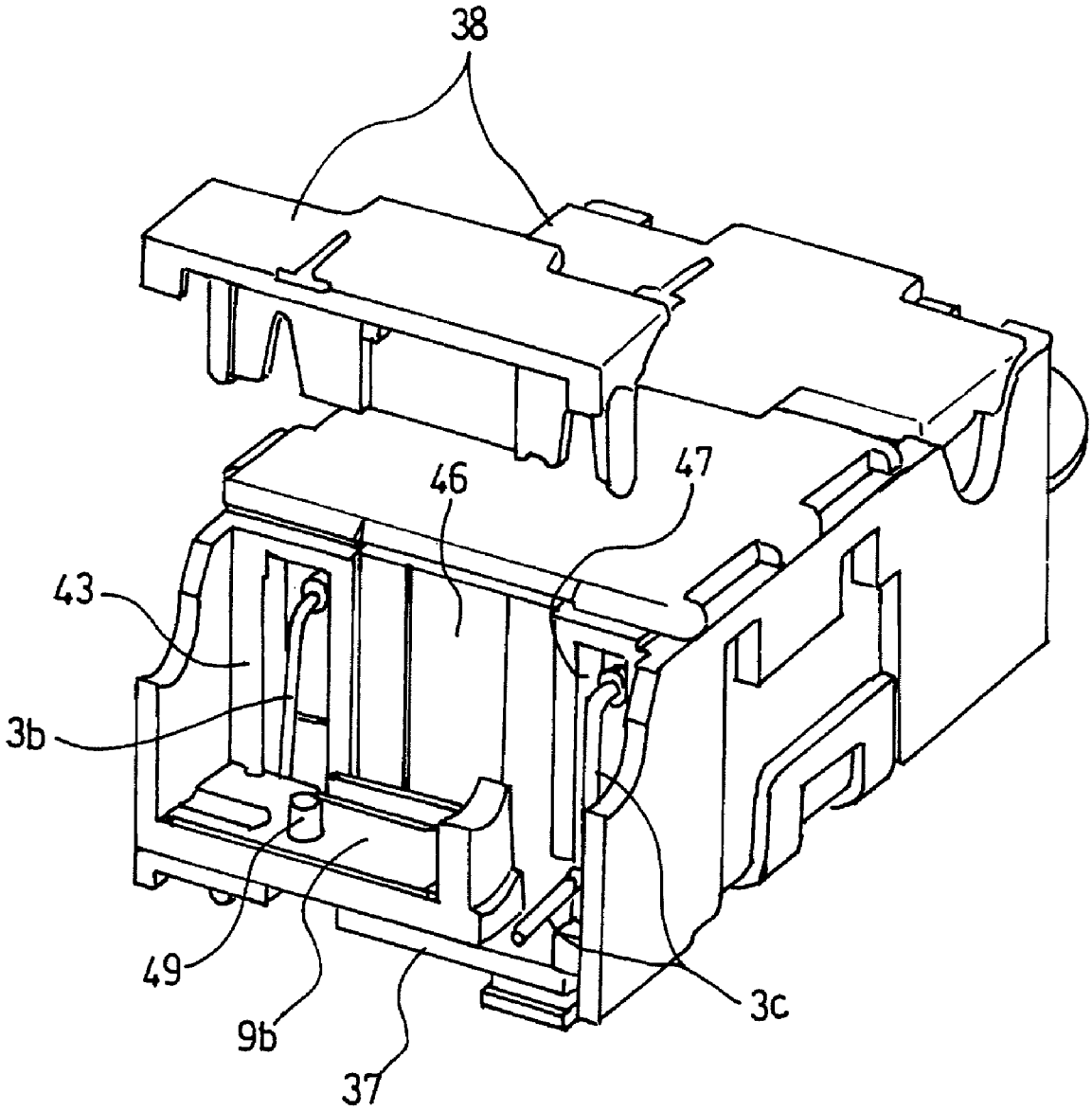
FIG. 5 is a perspective view showing the manner of attaching a terminal cover to the unit case.
Figure 6:
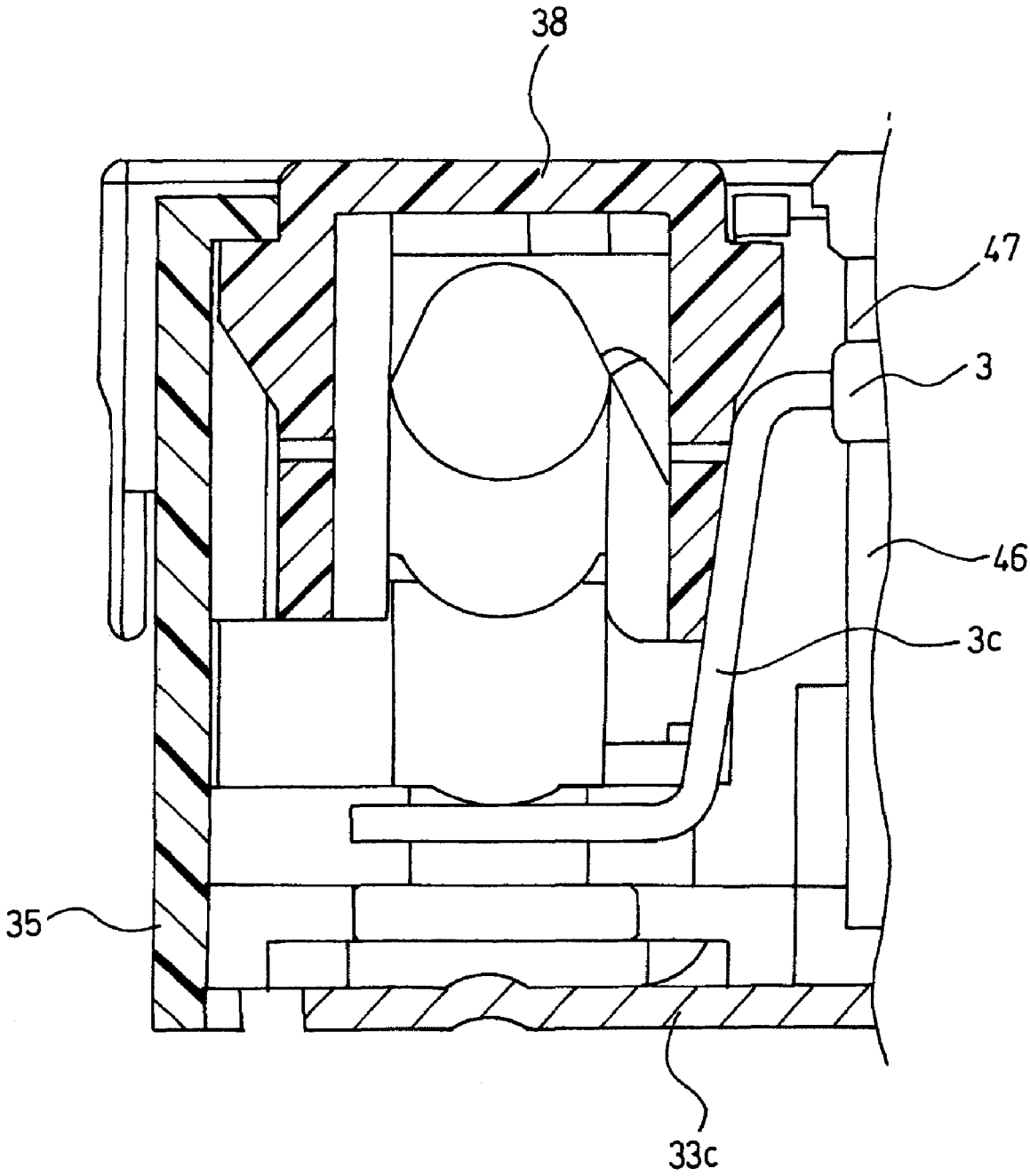
FIG. 6 is a view showing a wire passage position obtained when the terminal cover is attached to the unit case.

The lead terminals 2*b*, 2*c*, 3*b* and 3*c* of the two electrical elements 2 and 3, received in the element receiving portion covered with the element receiving portion cover 36, pass through corresponding lead passage holes 47 formed through partition walls 46 (see FIGS. 5 and 6) separating the respective parts receiving portions 43 from the element receiving portion, and are located respectively at predetermined positions within the parts receiving portions 43.

As shown in FIG. 4, each parts receiving portion 43 includes a projection 49 (see FIG. 5) for positioning the lead connection portion 9*b* of the relay terminal 9 received in the parts receiving portion 43, a spring protection portion 51 for protecting a spring portion of the received relay terminal 9, notch portions 52 for the passage of the wire(s) 5, 6 therethrough, terminal cover guide grooves 53 for guiding the insertion of the terminal cover 38 into the parts receiving portion 43, and lock portions 54 for locking the terminal cover 38 inserted in the parts receiving portion 43.

Each terminal cover 38 receiving and holding the wire terminal 7 press-clamped to the wire(s) 5, 6 is mounted in the part receiving portion 43.

Figure 7:
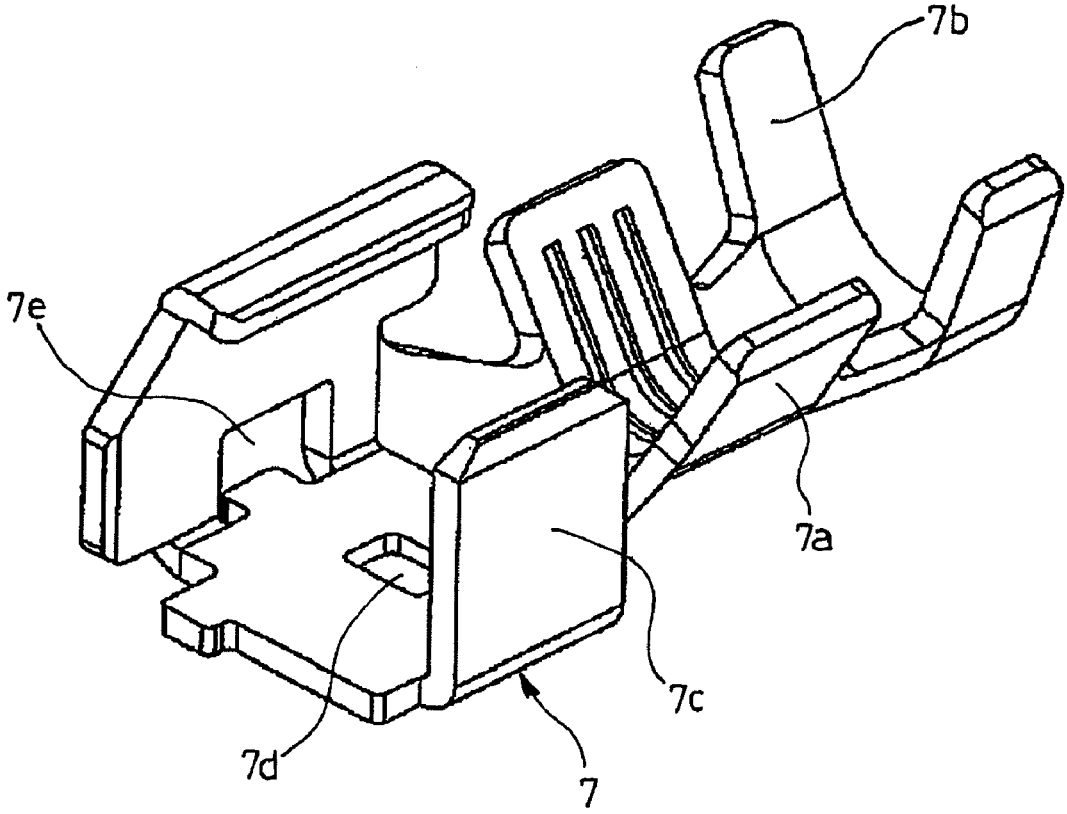
FIG. 7A is a perspective view of a wire terminal shown in FIG. 2.
FIG. 7B is a perspective view of the wire terminal press-fastened to a wire.
Figure 7:
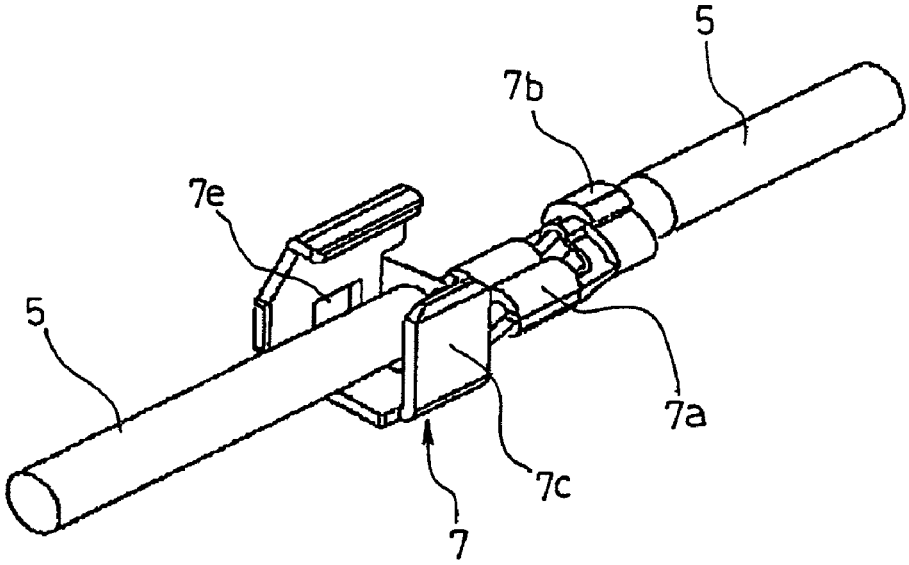

As shown in FIG. 7, the wire terminal 7 includes the wire connection portion 7*a* for being press-fastened to a conductor of the wire(s) 5, 6 to be electrically connected thereto, a sheath gripping portion 7*b* for gripping a sheath of the wire(s) 5, 6, the external connection terminal portion 7*c* for electrically connecting the wire connection portion 7*a* to the exterior, a positioning hole 7*d* for engagement with a positioning projection 62 of the terminal cover 38 to position the wire terminal 7 relative to the terminal cover 38, and a lock portion 7*e* for engagement with a terminal retaining projection 63 of the terminal cover 38 to fix the wire terminal 7 to the terminal cover 38.

Figure 8:
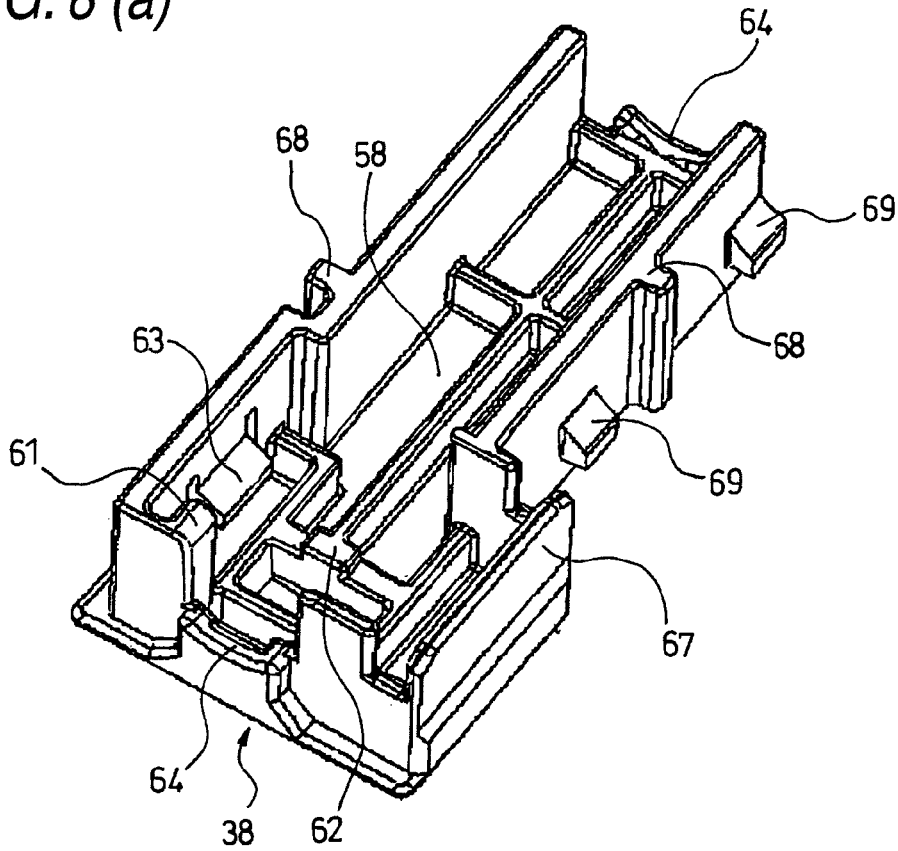
FIG. 8A is a perspective view of the terminal cover shown in FIG. 2.
FIG. 8B is a perspective view of the terminal cover as seen from a different angle.
Figure 8:
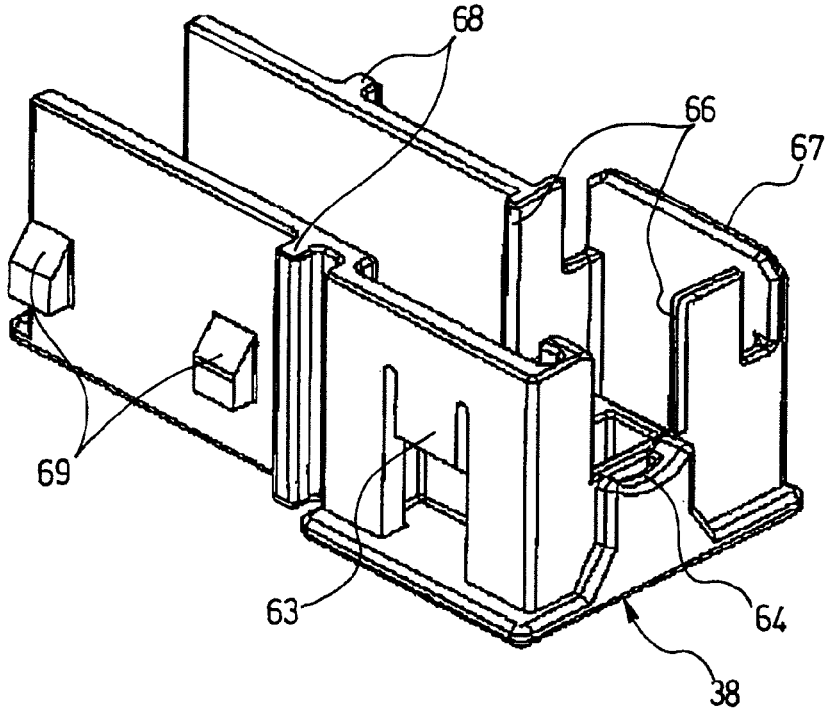

As shown in FIG. 8, the terminal cover 38 has a cavity (or space) 58 for receiving the wire terminal 7 therein, and includes, within this cavity 38, a guide rib 61 for guiding the insertion of the wire terminal 7 into a proper locking position, the positioning projection 62 for engagement with the positioning hole 7*d* of the wire terminal 7, inserted along the guide rib 61, so as to position the wire terminal 7, the terminal lock arm (terminal retaining projection) 63 for fixing the positioned wire terminal 7, notch portions 64 for the passage of the wire(s) 5, 6 there through, and a pair of upstanding reverse insertion prevention ribs 66 spaced from each other by a distance corresponding to the width of the external connection terminal portion 7*c* of the wire terminal 7 so as to prevent reverse insertion of the wire terminal 7.

As shown in FIG. 8, the terminal cover 38 further includes a terminal portion protection hood 67 for covering the outer side of the external connection terminal portion 7*c* of the wire terminal 7, received in the cavity 58, to protect this external connection terminal portion 7*c*.

Further, guide portions 68 for fitting in the respective terminal cover guide grooves 53 of the parts receiving portion 43 of the unit case 35, as well as lock beaks 69 for engagement with the respective lock portions 54 to fix the terminal cover 38 to the parts receiving portion 43, are formed on the outer peripheral surface of the terminal cover 38.

The terminal cover 38 receiving and holding the wire terminal 7 mounted on the wire 5 is fitted into the unit case 35 to be mounted therein, and covers the outer surface of the wire terminal 7 received in the unit case 35.

When the two opening covers 37 are inserted from the side surface side of the unit case 35 along the bottom wall 41 to be disposed respectively over the working openings 42, lock projections 37*a* formed respectively on inner side surfaces of the opening covers 37 are engaged respectively with engagement portions 71 formed on the bottom wall 41, so that the opening covers 37 are connected with the bottom wall 41.

In this embodiment, the two opening covers 37 are formed integrally with an elastic piece cover 73 for covering the outer surface of the elastic engagement piece portion 33*f* of the earth place 33 fixed to the unit case 35.

The engagement piece cover 73 is formed integrally with the two opening covers 37 to interconnect proximal ends of the two opening covers 37. When the two opening covers 37 are fixed to the bottom wall 41, the engagement piece cover 73 covers the outer surface of the elastic engagement piece portion 33*f*.

Figure 9:
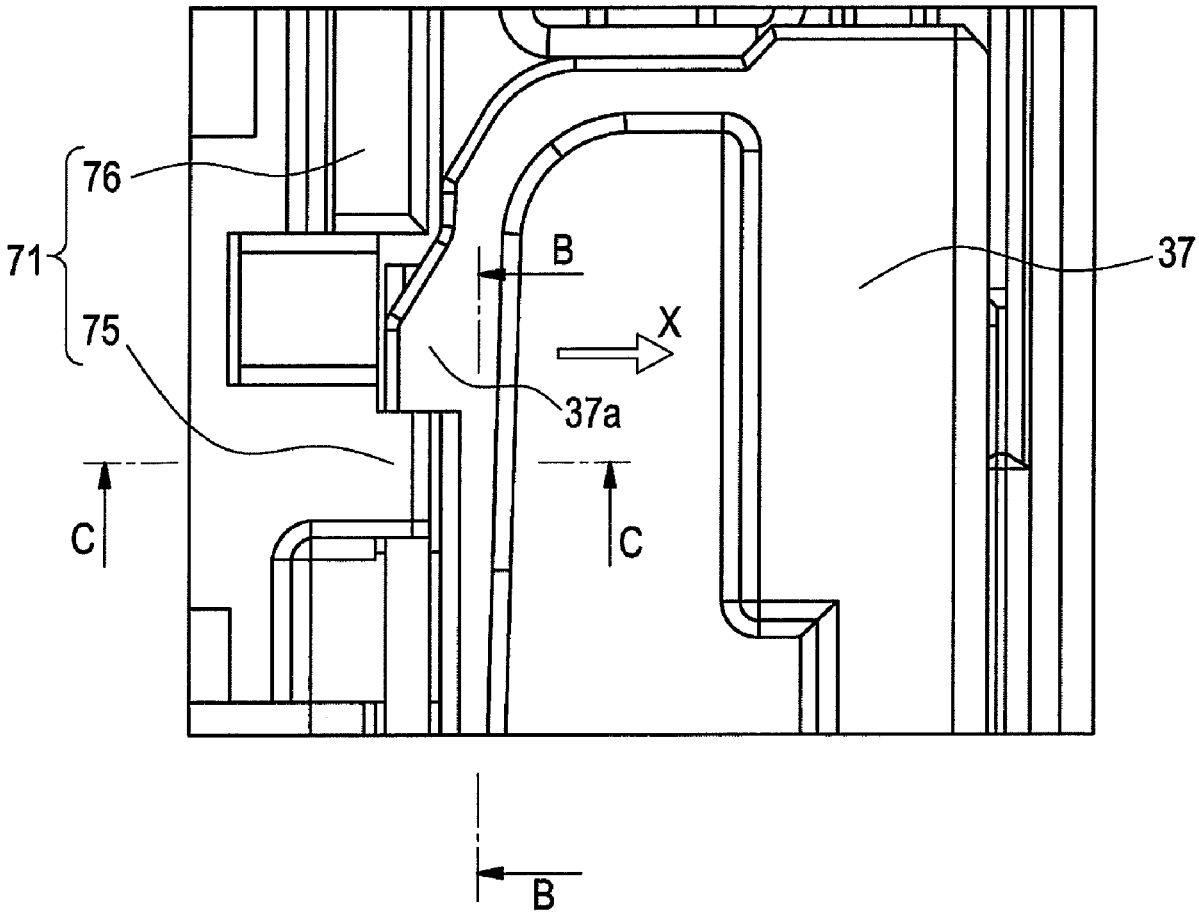
FIG. 9 is an enlarged view of a portion A of FIG. 3.
Figure 10:
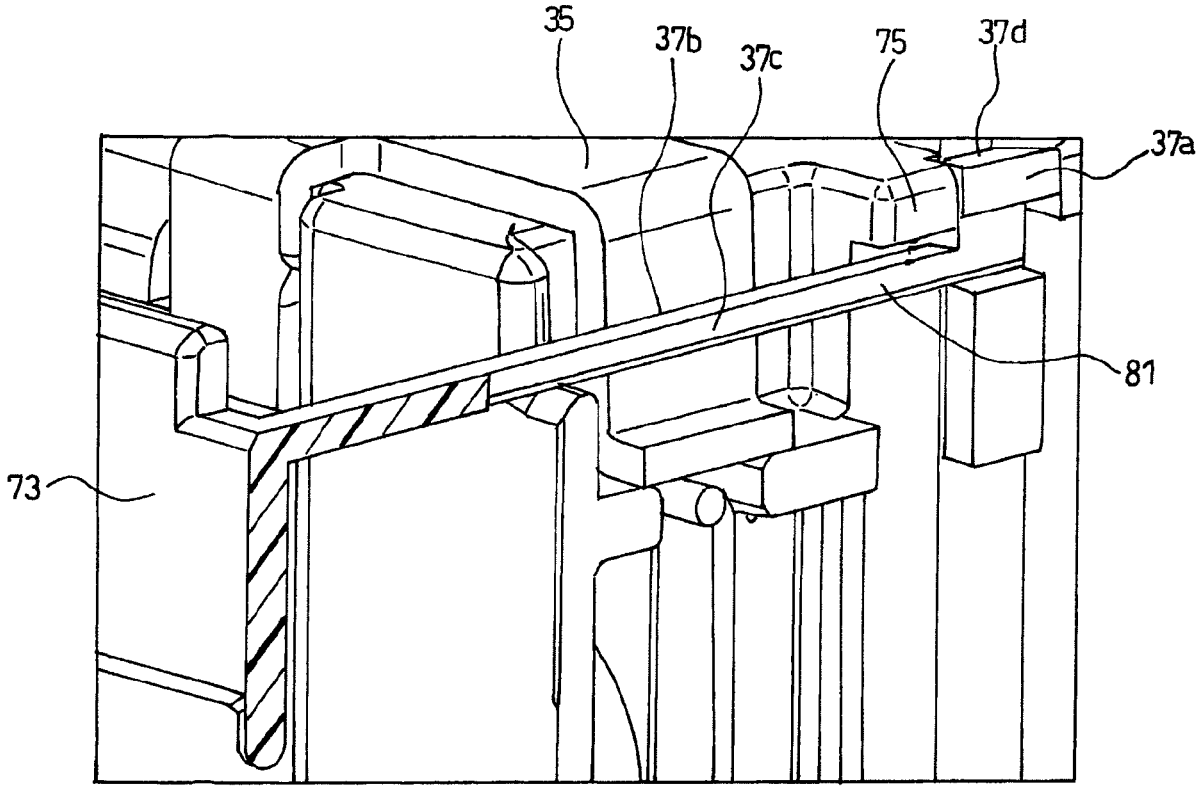
FIG. 10 is a perspective view of a cross-section taken along the line B-B of FIG. 9.
Figure 11:
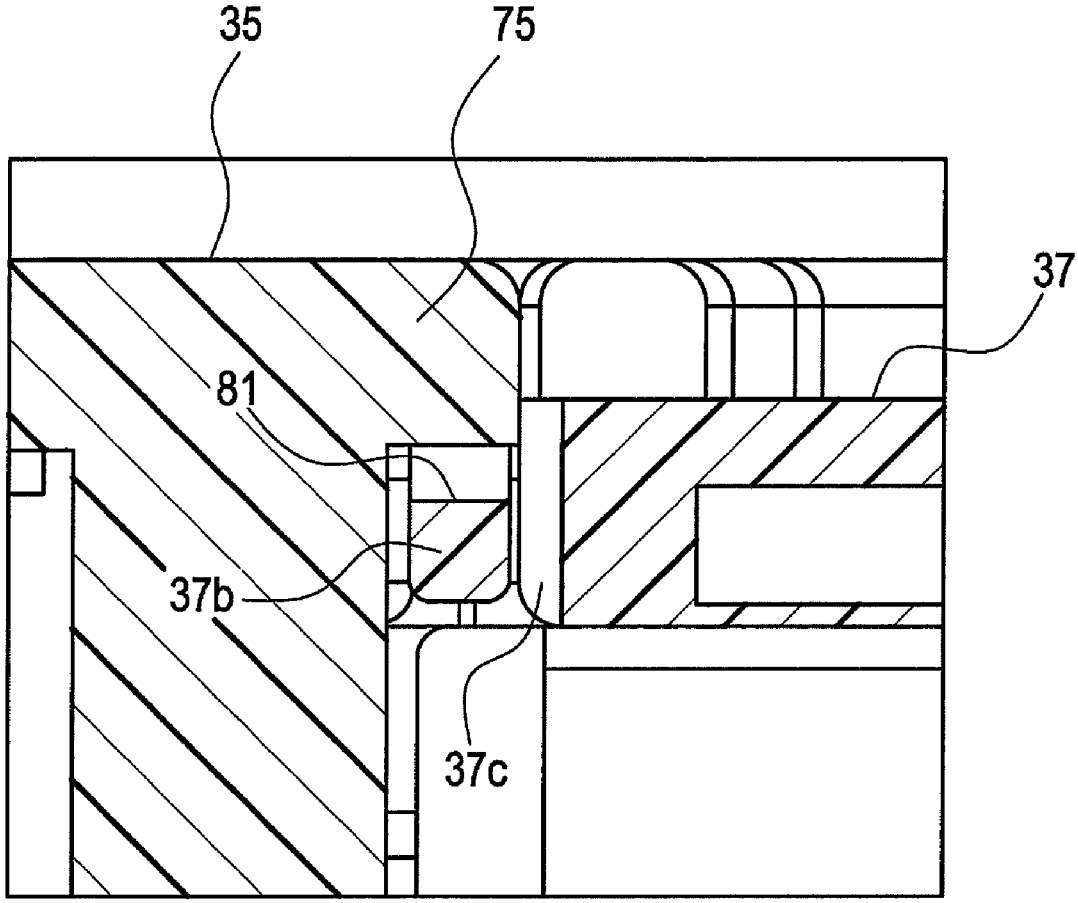
FIG. 11 is a cross-sectional view taken along the line C-C of FIG. 9.
Figure 12:
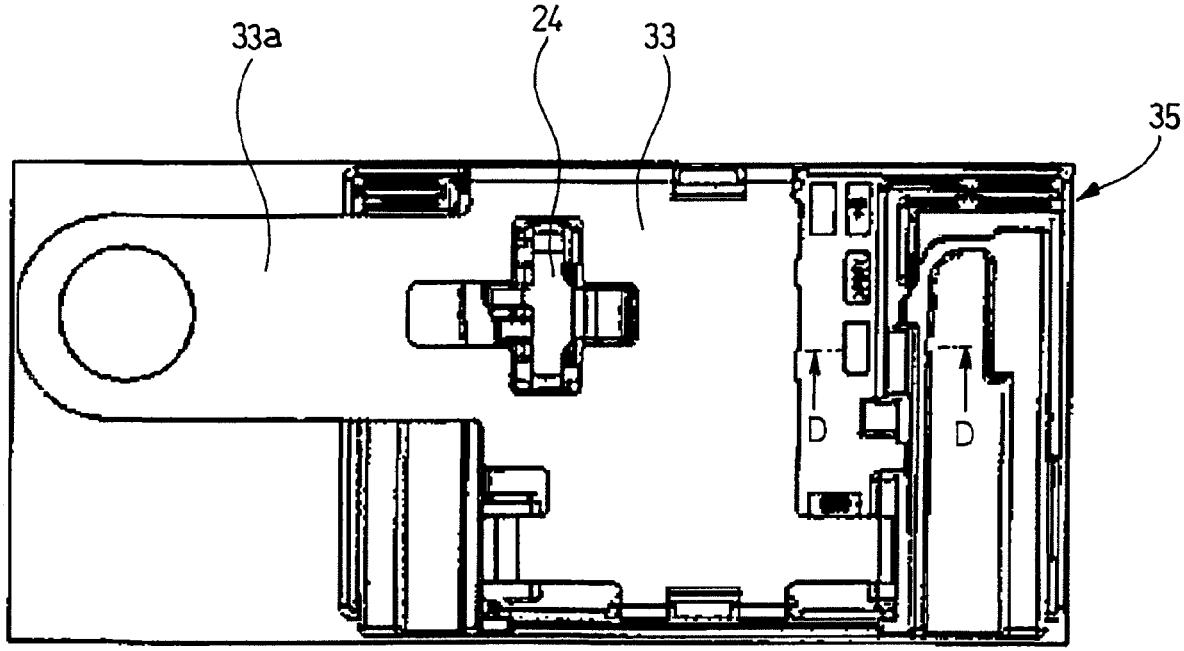
FIG. 12 is a front-elevational view showing a condition in which opening covers attached to the unit case are disposed in a completely-retained condition.
Figure 13:
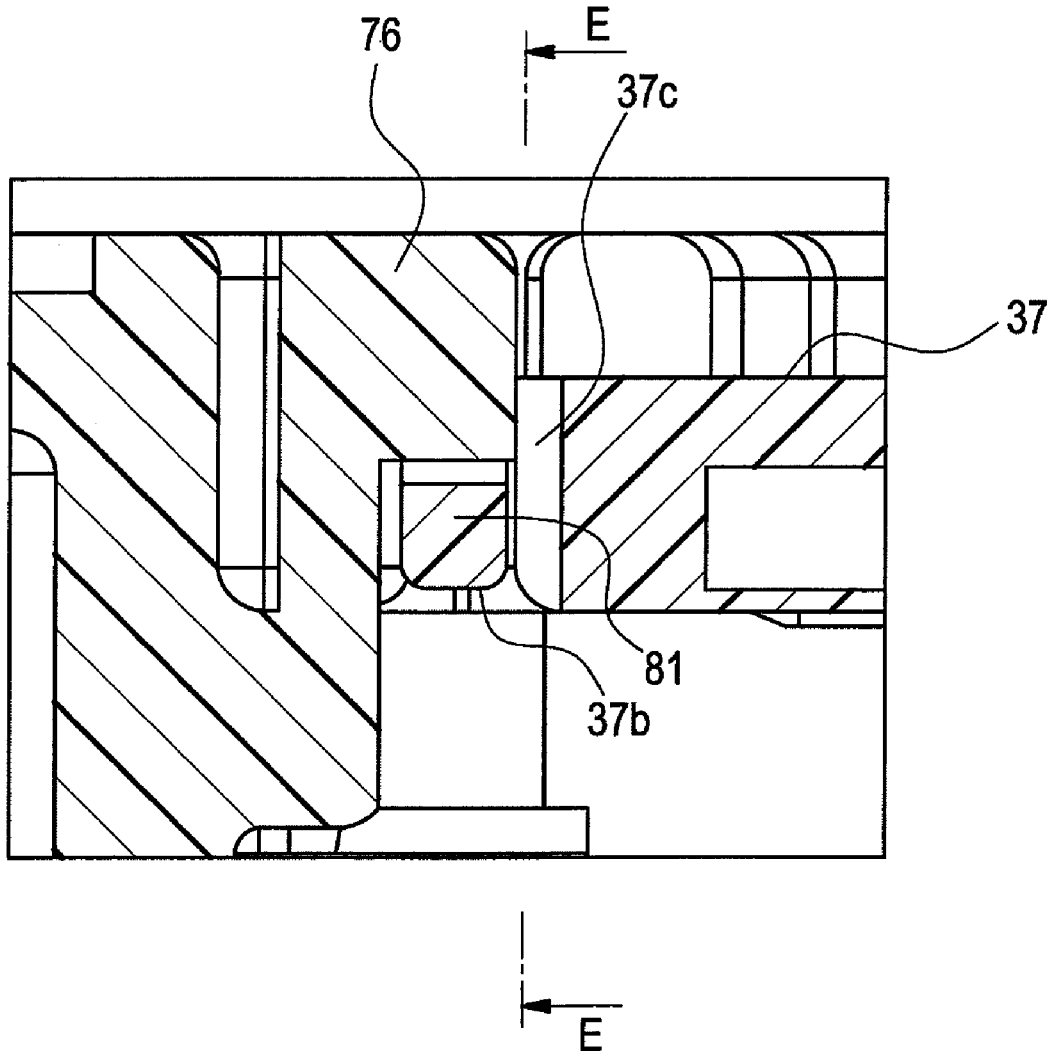
FIG. 13 is a cross-sectional view taken along the line D-D of FIG. 12.
Figure 14:
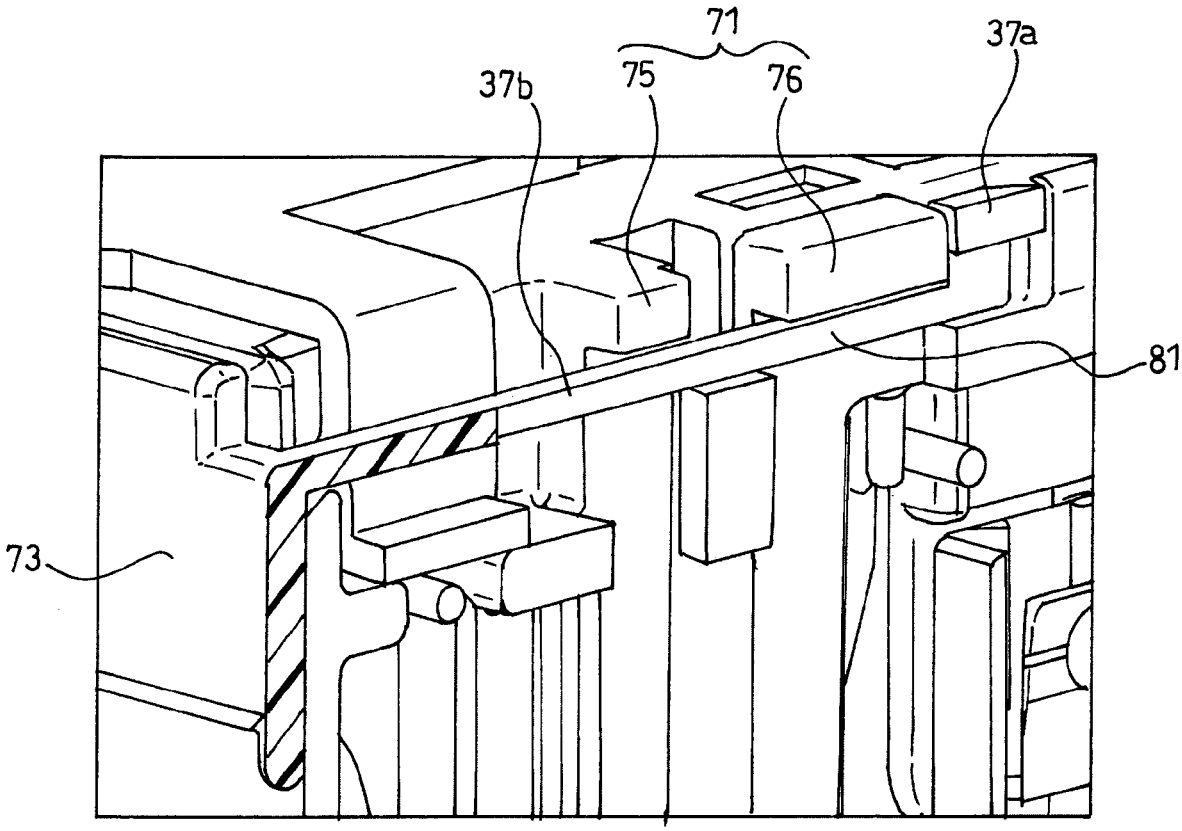
FIG. 14 is a perspective view of a cross-section taken along the line E-E of FIG. 13.

In this embodiment, each opening cover 37 has an elastic support portion 37*b* which displaces the lock projection 37*a* in a direction (direction X in FIG. 9) away from the engagement portion 71 when the lock projection 37*a* is to be engaged with the engagement portion 71 of the bottom wall 41 so that the lock projection 37*a* can be easily engaged with the engagement portion 71.

As shown in FIG. 2, a slit 37*c* extending in the direction of insertion of the opening cover 37 is formed in the opening cover 37 at the inner side of the lock projection 37*a*, and with this construction the elastic support portion 37*b* is formed into a generally leaf spring-shape extending in the direction of insertion of the opening cover 37.

In this embodiment, that portion of the elastic support portion 37*b* extending from the lock projection 37*a* to the proximal end portion of the opening cover 37 is disposed at a level below an upper surface 37*d* of the lock projection 37*a* as shown in FIGS. 10 to 14, and serves as a rib 81 which can be located under the engagement portion 71 with which the lock projection 37*a* is engaged.

The engagement portion 71 formed on the bottom wall 41 so as to retain the lock projection 37*a* of the opening cover 37 includes a provisionally-retaining portion 75 for engagement with the lock projection 37*a* during the insertion of the opening cover 37 onto the bottom wall 41 to prevent the withdrawal of the opening cover 37, and a completely-retaining portion 76 for engagement with the lock projection 37*a* upon complete insertion of the opening cover 37 to prevent the withdrawal of the opening cover 37. The provisionally-retaining portion 75 and the completely-retaining portion 76 project in the direction of the width of the opening cover 37 (that is, in a right-left direction in FIG. 9).

The opening covers 37 shown in FIG. 3 are provisionally retained respectively by the provisionally-retaining portions 75 of the bottom wall 41, and in this provisionally-retained condition distal end portions of the opening covers 37 do not yet reach the working openings 42, respectively, and a soldering operation and a conduction examination can be effected through the working openings 42.

When the opening covers 37 are further inserted from the provisionally-retained position, the lock projections 37*a* are engaged respectively with the completely-retaining portions 76, so that the opening covers 37 are completely retained. In this completely-retained condition, the working openings 42 are covered with the opening covers 37, respectively.

The above-mentioned earth connection unit 31 is assembled according to the procedure or process comprising the steps (assembling steps) described in the following Paragraphs [1] to [9].

[1] First, the electrical elements 2 and 3 are mounted in the element receiving portion of the unit case 35. At this time, the lead terminals 2*b*, 2*c*, 3*b* and 3*c* of the electrical elements 2 and 3 are passed through the respective lead passage holes 47 formed through the partition walls 46 (see FIG. 5) separating the respective parts receiving portions 43 from the element receiving portion, and are located respectively at the predetermined positions within the parts receiving portions 43.

[2] Then, the relay terminals 9 are mounted respectively in the parts receiving portions 43 of the unit case 35 as shown in FIG. 4.

[3] Then, the earth plate 33 is fixed to the bottom wall 41 of the unit case 35 as shown in FIG. 3.

[4] Then, the lead terminals 2*b* and 3*b* of the electrical elements 2 and 3 are electrically connected (that is, soldered) to the relay terminals 9, respectively, and also the lead terminals 2*c* and 3*c* are electrically connected (that is, soldered) to the element connection portions 33*c* of the earth plate 33, respectively.

[5] Then, the element receiving portion of the unit case 35 is covered with the element receiving portion cover 36, and also the opening covers 37 are attached in a provisionally-retained condition to the unit case 35, thus obtaining the half-assembled condition shown in FIGS. 3 and 4.

[6] Then, the wire terminals 7 are press-clamped to the portions of the wires 5 and 6 from which their respective sheaths are removed, and these wire terminals 7 are mounted in the terminal covers 38, respectively.

[7] Then, the terminal covers 38 each having the wire terminal 7 mounted therein are fitted into the respective parts receiving portions 43 to be mounted therein.

[8] Then, the plate clamp 24 of the unit case 35 is fitted into the clamp hole in the vehicle body, and the unit case 35 is connected with the vehicle body.

[9] Then, the earth connection portion 33*a* of the earth plate 33 is screw-fastened to the vehicle body to be electrically connected thereto. As a result, noise components flowing through the wires 5 and 6 are grounded to the vehicle body via the relay terminals 9, the electrical elements 2 and 3 and the earth plate 33, and thus the earth connection unit 31 functions as a noise filter.

In the earth connection unit 31 of the above construction, the elastic engagement piece portion 33*f* of the earth plate 33 for locking the earth plate 33 to the unit case 35 is engaged with the engagement projection 25 formed on the outer side surface of the unit case 35. In this condition, the engagement piece cover 73 integrally interconnecting the two opening covers 37 is disposed in generally superposed relation to the outer surface of the elastic engagement piece portion 33*f*, and therefore the elastic engagement piece portion 33*f* is covered with the engagement piece cover 73.

Namely, the elastic engagement piece portion 33*f* (serving as the lock means) formed on the earth plate 33 is covered with the engagement piece cover 73 integrally interconnecting the two opening covers 37, and is not exposed to the exterior.

Therefore, the locked condition of the earth plate 33 relative to the unit case 35 will not be accidentally canceled by contact from the exterior or other factors, and the fixed condition of the earth plate 33 can be maintained in a stable manner.

In addition, since the elastic engagement piece portion 33*f* of the earth plate 33 is covered with the engagement piece cover 73 integrally interconnecting the two opening covers 37, the wires 5 and 6 received in the earth connection unit 31 are prevented from contact with the end edge of the elastic engagement piece portion 33*f*, and therefore is prevented from being damaged by this contact.

Furthermore, the two opening covers 37 are integrally interconnected by the engagement piece cover 73, and therefore the two opening covers 37 can be attached to the unit case 35 at one time, and the number of the component parts as well as the number of the assembling steps can be reduced.

Furthermore, in the earth connection unit 31 of the above construction, when the lock projection 37*a* of each opening cover 37 is to be engaged with the engagement portion 71 of the bottom wall 41 of the unit case 35, the elastic support portion 37*b* is elastically deformed to displace the lock projection 37*a* in the direction to facilitate this engagement. Therefore, as compared with the case where the lock projection 37*a* is not displaced, an excessive load will not act on the lock projection 37*a*, thereby avoiding damage of the lock projection 37*a* which would otherwise be caused by the forcible fitting of the opening cover 37.

Furthermore, an operating force required for attaching the opening covers 37 to the unit case 35 can be reduced, and therefore the efficiency of the operation can also be enhanced.

Furthermore, in the earth connection unit 31 of the above construction, each opening cover 37 has the rib 81 disposed at the proximal end of the lock projection 37*a*, and when the lock projection 37*a* is engaged with the provisionally-retaining portion 75 or the completely-retaining portion 76 formed on the bottom wall 41 of the unit case 35, this rib 81 is located under each of these retaining portions. Thanks to the engagement of the rib 81 with each retaining portion 75, 76, each opening cover 37 engaged with the unit case 35 is prevented from being lifted, and therefore can be more positively retained on the unit case 35, and at the same time the opening covers 37 disposed, for example, in their provisionally-retained condition are prevented from being brought out of engagement with the unit case 35 and hence are prevented from dropping from the unit case 35.

Figure 15:
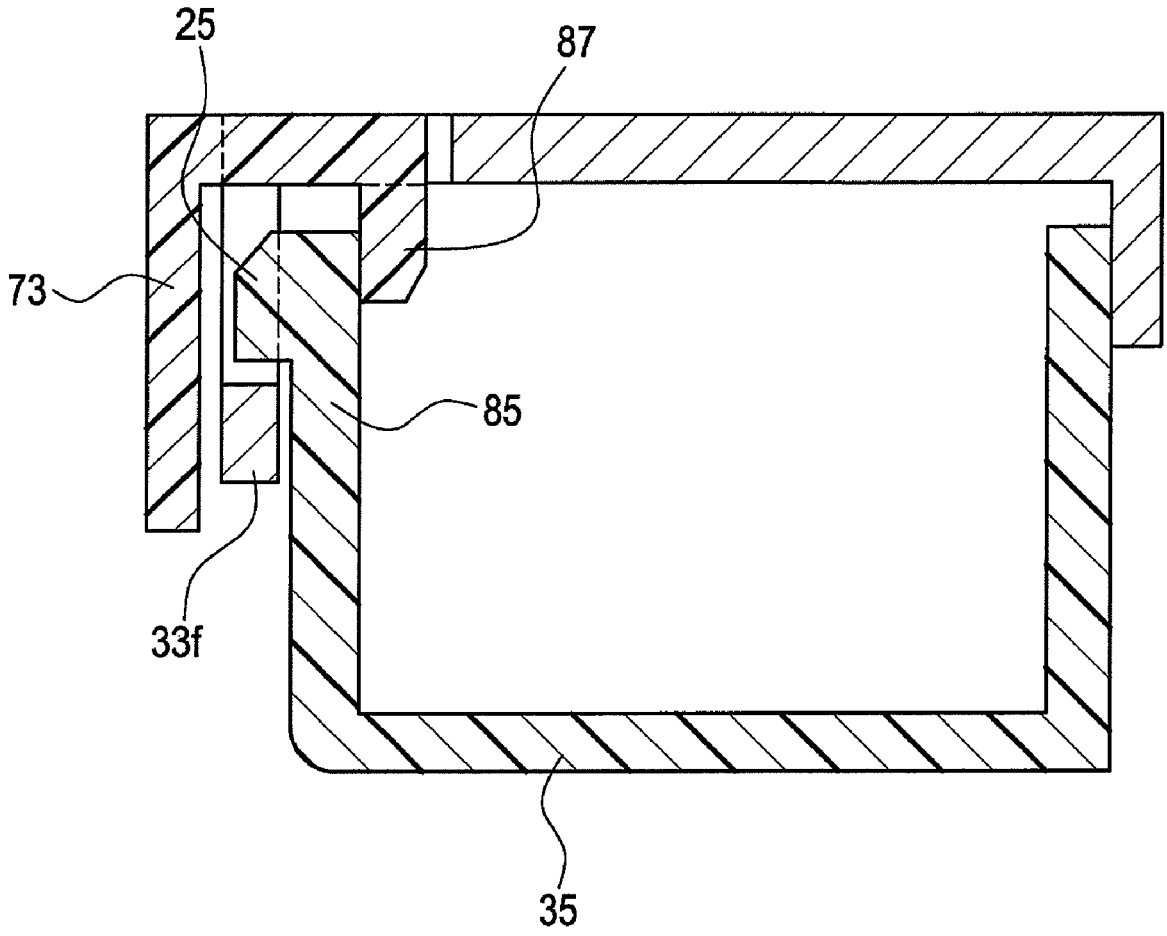
FIG. 15 is a view roughly showing the construction of modified opening covers used in the earth connection unit of the invention.
Figure 16:
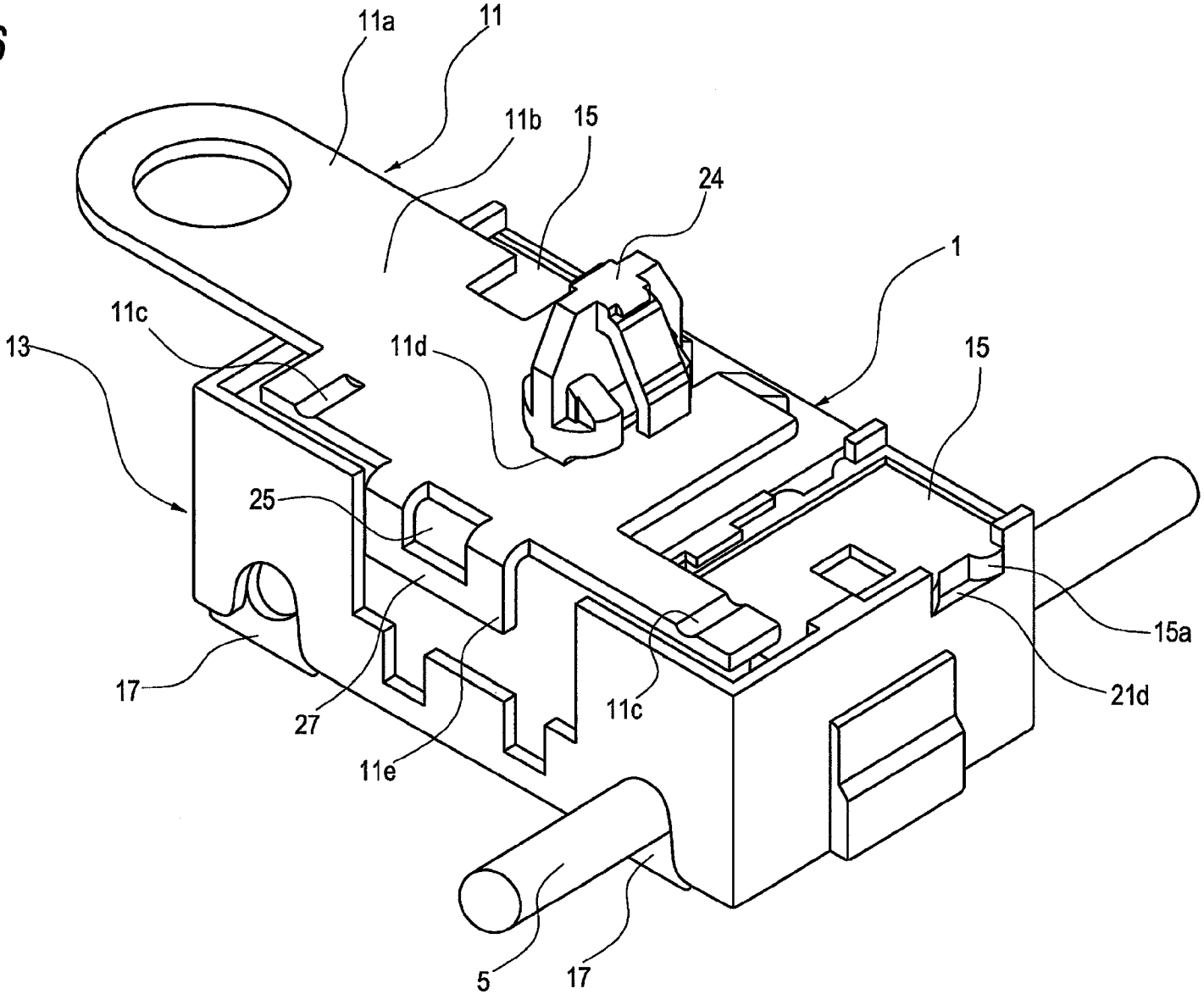
FIG. 16 is a perspective view of a conventional earth connection unit.
Figure 17:
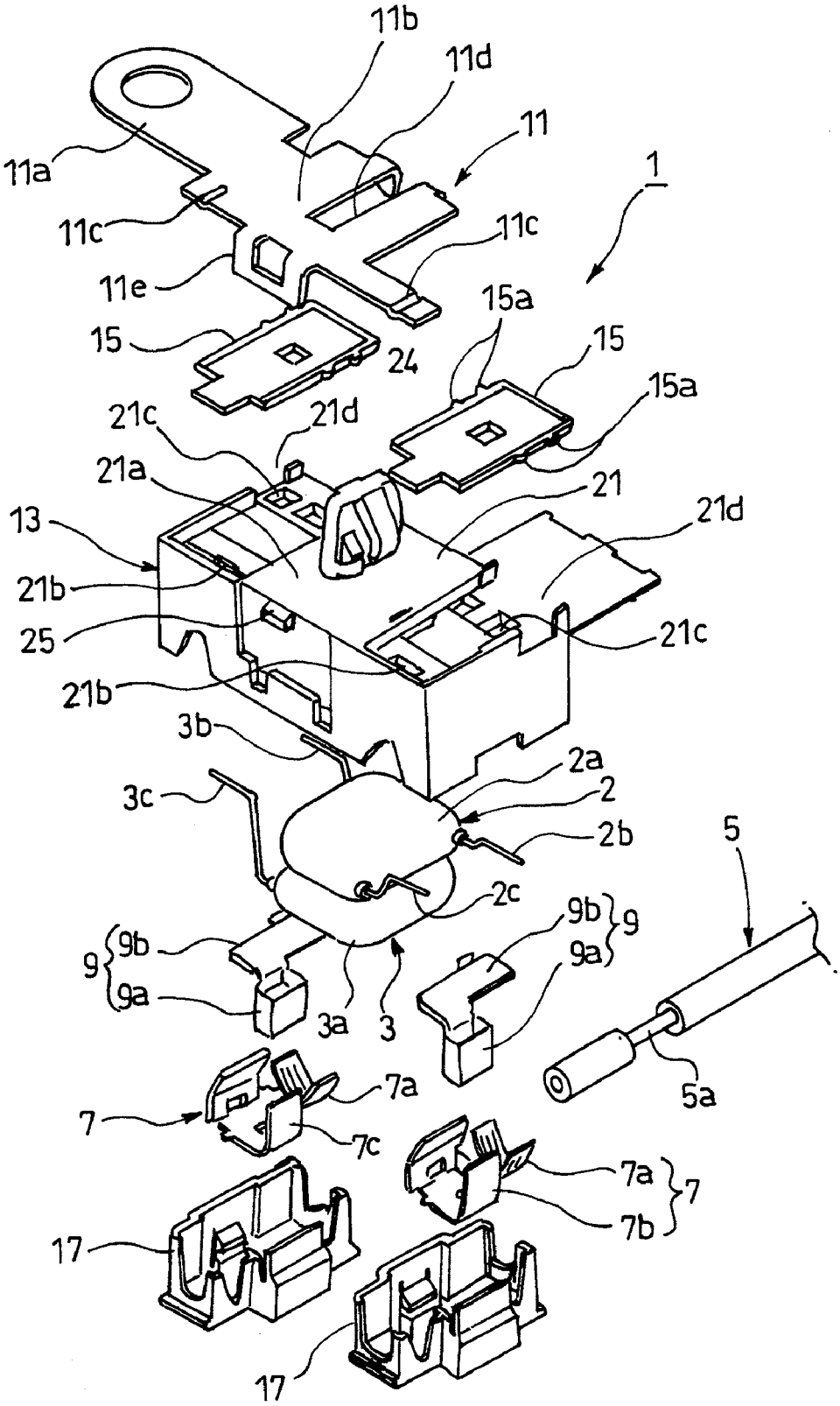
FIG. 17 is an exploded perspective view of the earth connection unit of FIG. 16.

As shown in FIG. 15, a lock piece 87 for holding a side wall 85 of the unit case 35 (having the engagement projection 25) between it and the engagement piece cover 73 may be formed integrally on the engagement piece cover 73.

With this construction, the lock cancellation prevention effect of the elastic engagement piece portion 33*f* is further enhanced, and at the same time the strength of fixing of the engagement piece cover 73 to the unit case 35 can also be enhanced.

In the earth connection unit of the present invention, the number of the working openings to be formed in the unit case, as well as the number of the opening covers for respectively covering these working openings, are varied according to the number of the electrical elements to be received in the unit case. The number of the electrical elements to be received in the unit case is not limited to two, and the unit case can be so constructed as to receive more than two electrical elements. In this case, the number of the working openings in the unit case, as well as the number of the opening covers for respectively covering these working openings, are more than two, and the engagement piece cover 73 for covering the outer surface of the elastic engagement piece portion 33*f* of the earth plate integrally interconnects more than two opening covers.

The present invention is not limited to the above embodiment, and suitable modifications, improvements, etc. can be made. Furthermore, the material, shape, dimensions, numeral value, form, number, disposition, etc., of each of the constituent elements of the above embodiment are not limited and are arbitrary in so far as the invention can be achieved.

What is claimed is:

1. An earth connection unit, comprising:

a plurality of electrical elements, each having an element body and a pair of lead terminals extending from the element body;

wire terminals, each including a wire connection portion to be electrically connected with a respective one of a plurality of wires and an external connection terminal portion for electrically connecting the wire connection portion to an exterior;

relay terminals, each made of a metal sheet and including a terminal connection portion to be electrically connected with the external connection terminal of the corresponding wire terminal and a lead connection portion to be soldered to one of the pair of lead terminals of the corresponding electrical element;

an earth plate, made of a metal plate and including a mounting plate portion, an earth connection portion extending from one edge of the mounting plate portion so as to be fastened to an earth connection-purpose structural member, and a plurality of element connection portions extending from other edges of the mounting plate portion so as to be electrically connected respectively to the other lead terminals of the plurality of electrical elements;

a synthetic resin-made unit case, including a bottom wall, a plate portion placing portion on which the mounting plate portion of the earth plate is placed, connection portion placing portions on which the respective element connection portions is placed, the plate placing portion and connection portion placing portions being formed on an outer surface of the bottom wall, the unit case including parts receiving portions provided at the inner side of the bottom wall so as to receive the electrical elements, the relay terminals and the wire terminals, and a plurality of openings being formed through the bottom wall such that each relay terminal and the one lead terminal of the corresponding electrical element which are received in the corresponding parts receiving portion in contacted relation to each other can be soldered together through the corresponding opening; and a plurality of opening covers so configured that when the opening covers are inserted from the side surface side of the unit case along the bottom wall to be disposed respectively over the openings, lock projections formed respectively on the opening covers are engaged respectively with engagement portions formed on the bottom wall, so that the opening covers are fixed to the bottom wall to close the respective openings;

wherein when an elastic engagement piece portion formed on and extending from a side edge of the mounting plate portion of the earth plate is engaged with an engagement projection formed on an outer side surface of the unit case, the earth plate is locked to the unit case; and wherein an engagement piece cover is provided for covering an outer surface of the elastic engagement piece portion of the earth plate, and the plurality of opening covers are formed integrally with the engagement piece cover.

2. The earth connection unit according to claim 1, wherein an elastic support portion is formed on each of the opening covers, and when the lock projection of each of the opening covers is to be engaged with the corresponding engagement portion of the bottom wall, the elastic support portion is elastically deformed to displace the lock projection in a direction to facilitate the engagement.

3. The earth connection unit according to claim 2, wherein the engagement portion includes a provisionally-retaining portion formed on the bottom wall so as to be engaged with the lock projection during the insertion of the opening cover onto the bottom wall so as to prevent the withdrawal of the opening cover, and a completely-retaining portion formed on the bottom wall so as to be engaged with the lock projection upon complete insertion of the opening cover to thereby prevent the withdrawal of the opening cover, and the provisionally-retaining portion and the completely-retaining portion project in a direction of a width of the opening cover; and the opening cover has a rib disposed at a level below an upper surface of the lock projection and extending in the inserting direction from the lock projection toward a proximal end of the opening cover, and the rib can be located under the engagement portion for engagement with the lock projection.

4. An earth connection unit, comprising:

an electrical element, having an element body and a pair of lead terminals extending from the element body;

a wire terminal, including a wire connection portion to be electrically connected with a wire and an external connection terminal portion for electrically connecting the wire connection portion to an exterior;

a relay terminal, made of a metal sheet and including a terminal connection portion to be electrically connected with the external connection terminal of the wire terminal and a lead connection portion to be soldered to one of the pair of lead terminals;

an earth plate, made of a metal plate and including a mounting plate portion, an earth connection portion extending from one edge of the mounting plate portion so as to be fastened to an earth connection-purpose structural member, and a element connection portion extending from other edge of the mounting plate portion so as to be electrically connected respectively to other of the pair of lead terminal of the electrical element;

a synthetic resin-made unit case, including a bottom wall, a plate portion placing portion on which the mounting plate portion of the earth plate is placed, a connection portion placing portion on which the element connection portion is placed, the plate placing portion and connection portion placing portions being formed on an outer surface of the bottom wall, the unit case including a part receiving portion provided at the inner side of the bottom wall so as to receive the electrical element, the relay terminal and the wire terminal, and an opening being formed through the bottom wall such that the relay terminal and the one lead terminal of the electrical element which are received in the part receiving portion in contacted relation to each other are soldered together through the opening; and a plurality of opening covers configured so that when the opening cover is inserted from a side surface side of the unit case along the bottom wall to be disposed over the opening, a lock projection formed on the opening cover is engaged with an engagement portion formed on the bottom wall, so that the opening cover is fixed to the bottom wall to close the opening;

wherein when an elastic engagement piece portion extending from a side edge of the mounting plate portion of the earth plate is engaged with an engagement projection formed on an outer side surface of the unit case, the earth plate is locked to the unit case; and wherein an engagement piece cover is provided for covering an outer surface of the elastic engagement piece portion of the earth plate, and the opening cover is formed integrally with the engagement piece cover.

* * * * *